US011708101B2

(12) United States Patent
Rajanna et al.

(10) Patent No.: US 11,708,101 B2
(45) Date of Patent: Jul. 25, 2023

(54) VEHICLE ORIENTATION DETERMINATION SYSTEM

(71) Applicant: Westinghouse Air Brake Technologies Corporation, Wilmerding, PA (US)

(72) Inventors: Sunil Rajanna, Bangaluru (IN); Manjunath Dwarakanath, Bangaluru (IN); Vimal Ramamoorthy, Bangaluru (IN)

(73) Assignee: Westinghouse Air Brake Technologies Corporation, Pittsburgh, PA (US)

( * ) Notice: Subject to any disclaimer, the term of this patent is extended or adjusted under 35 U.S.C. 154(b) by 606 days.

(21) Appl. No.: 16/781,484

(22) Filed: Feb. 4, 2020

(65) Prior Publication Data

US 2021/0237786 A1 Aug. 5, 2021

(51) Int. Cl.
*B61L 25/02* (2006.01)

(52) U.S. Cl.
CPC ..... *B61L 25/025* (2013.01); *B61L 25/028* (2013.01); *B61L 2205/04* (2013.01)

(58) Field of Classification Search
CPC ..... B61L 2205/02; B61L 2205/04; B61L 25/025; B61L 25/026; B61L 25/028; B61L 25/021
See application file for complete search history.

(56) References Cited

U.S. PATENT DOCUMENTS 6,377,215 B1 4/2002 Halvorson et al.
9,550,484 B2 1/2017 Smith et al.
9,963,836 B1 * 5/2018 Brenner ..... E01C 19/42
10,173,698 B2 1/2019 Schoenly et al.
10,338,580 B2 7/2019 Smith et al.
10,464,579 B2 11/2019 Cooper et al.
2004/0267450 A1 12/2004 Kemwein
2005/0010338 A1 * 1/2005 Kraeling ..... B61L 25/023 701/19
2007/0239327 A1 10/2007 Smith et al.
2009/0248226 A1 10/2009 Kellner et al.
2013/0261842 A1 * 10/2013 Cooper ..... B61L 25/028 701/1
2017/0066458 A1 3/2017 Huchrowski
2017/0090473 A1 3/2017 Cooper et al.
2018/0170415 A1 * 6/2018 Oswald ..... B61L 25/023

* cited by examiner

*Primary Examiner* — Tarek Elarabi

(74) *Attorney, Agent, or Firm* — The Small Patent Law Group LLC; Philip S. Hof

(57) ABSTRACT

A vehicle orientation determination system includes one or more processors configured to determine a first distance between a reference device disposed on a first vehicle and a front device disposed on a second vehicle. The first and second vehicles are both disposed on a route. The one or more processors are further configured to determine a second distance between the reference device disposed on the first vehicle and a rear device disposed on the second vehicle. The front device is located more proximate to a front end of the second vehicle than a proximity of the rear device to the front end. The one or more processors are configured to determine that the second vehicle has a common orientation as the first vehicle relative to the route based on the first distance being less than the second distance.

20 Claims, 3 Drawing Sheets

VEHICLE ORIENTATION DETERMINATION SYSTEM

BACKGROUND

Technical Field

The subject matter describes embodiments relating to controlling vehicle systems.

Discussion of Art

Some propulsion-generating vehicles can drive in multiple orientations, essentially forward and backward. For example, locomotives can be arranged in a train in either a front-facing orientation or a rear-facing orientation relative to the direction of travel of the train along a track. When a vehicle is controlled remotely, the vehicle may be outside of the range of view of the operator that controls the vehicle. The orientation of the remotely-controlled vehicle relative to the route needs to be confirmed prior to the vehicle moving along the route. If the expected orientation of the vehicle is incorrect, the control signals may cause the vehicle to move in an opposite direction than desired, which can pose a safety and damage risk. For example, the vehicle may drive into another vehicle. In another example, if the vehicle is coupled to other propulsion-generating vehicles, the vehicles may generate tractive effort in opposite directions of each other. The resulting compressive and/or tensive forces that can damage mechanical linkages and other equipment. It may be desirable to have a system and method that differs from those that are currently available.

BRIEF DESCRIPTION

In one or more embodiments, a system (e.g., a vehicle orientation determination system) is provided that includes one or more processors configured to determine a first distance between a reference device disposed on a first vehicle and a front device disposed on a second vehicle. The first and second vehicles are both disposed on a route. The one or more processors are further configured to determine a second distance between the reference device disposed on the first vehicle and a rear device disposed on the second vehicle. The front device is located more proximate to a front end of the second vehicle than a proximity of the rear device to the front end. The one or more processors are configured to determine that the second vehicle has a common orientation as the first vehicle relative to the route based on the first distance being less than the second distance.

In one or more embodiments, a method for determining a vehicle orientation is provided that includes determining a first distance between a reference device disposed on a first vehicle and a front device disposed on a second vehicle. The first and second vehicles both disposed on a route. The method includes determining a second distance between the reference device disposed on the first vehicle and a rear device disposed on the second vehicle. The front device is located more proximate to a front end of the second vehicle than a proximity of the rear device to the front end. The method includes determining that the second vehicle has a common orientation as the first vehicle relative to the route based on the first distance being less than the second distance.

In one or more embodiments, a system (e.g., a vehicle orientation determination system) is provided that includes one or more processors disposed onboard a first vehicle of a vehicle system. The one or more processors are configured to receive, via a communication device onboard the first vehicle, a location of a front device disposed onboard a second vehicle of the vehicle system and a location of a rear device disposed onboard the second vehicle. The front device is located more proximate to a front end of the second vehicle than a proximity of the rear device to the front end. The one or more processors are configured to determine an orientation of the second vehicle relative to the first vehicle along a route based on a comparison of respective proximities of the front device and the rear device to a location of the first vehicle.

BRIEF DESCRIPTION OF THE DRAWINGS

The inventive subject matter may be understood from reading the following description of non-limiting embodiments, with reference to the attached drawings, wherein below.

DETAILED DESCRIPTION

One or more embodiments described herein are directed to a system and method for determining the orientation of a vehicle relative to another vehicle. The orientation refers to a rotation of the vehicle relative to a route on which the vehicle is traveling. The orientation is defined relative to a direction of travel of the vehicle along the route. For example, if a front end of the vehicle precedes a rear end of the vehicle along the route as the vehicle travels, then the vehicle may have a front-facing or forward orientation. Furthermore, if the rear end precedes the front end of the vehicle along the route as the vehicle travels, then the vehicle may have a rear-facing or reverse orientation.

The system and method described herein are configured to compare the proximity of a first vehicle to two different, spaced-apart devices on a second vehicle to determine the orientation of the second vehicle. By comparing the respective proximities, the system and method can determine whether the second vehicle has the same orientation as the first vehicle or an opposite orientation as the first vehicle. In the embodiments described herein, the orientation of the second vehicle can be automatically determined without requiring visual surveillance or observation of the second vehicle. For example, there is no need for generating image data of the second vehicle or manually walking to the second vehicle to enable the first vehicle to determine the orientation of the second vehicle. The system and method can be initiated by a single user input command, such as by an operator located on the first vehicle. The system and method can be used to determine the orientations of multiple "second" vehicles relative to the first vehicle.

Figure 1:
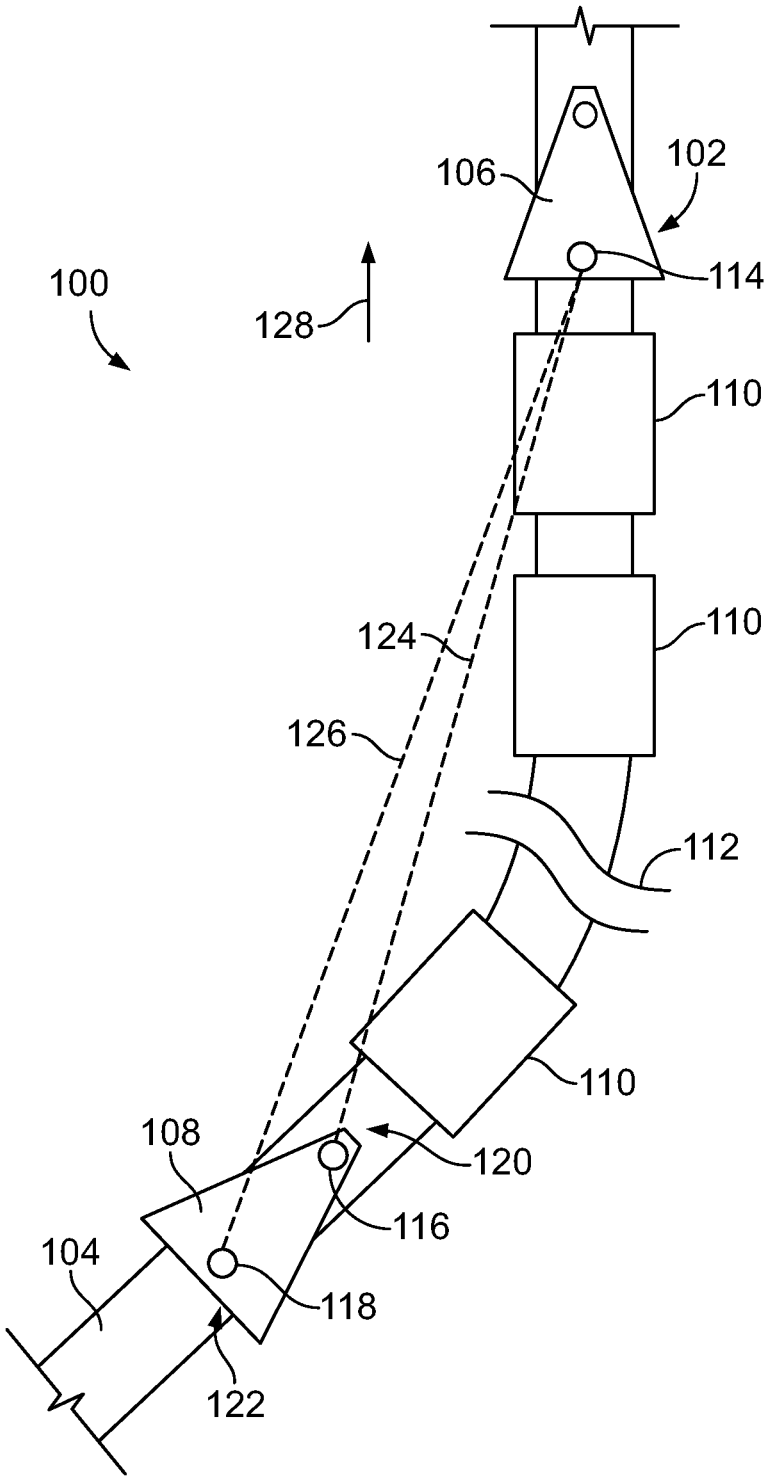
FIG. 1 illustrates an orientation determination system disposed on a vehicle system on a route according to an embodiment.

FIG. 1 illustrates an orientation determination system 100 disposed on a vehicle system 102 on a route 104 according to an embodiment. The vehicle system includes a first propulsion-generating vehicle 106 and a second propulsion-generating vehicle 108. Each of the propulsion-generating vehicles has a propulsion system to generate tractive forces for propelling the vehicle along the route. The vehicle system also includes multiple non-propulsion-generating vehicles 110 disposed between the propulsion-generating vehicles. The non-propulsion-generating vehicles include brake systems but lack propulsion systems. The non-propulsion-generating vehicles may be mechanically coupled to each other and to the propulsion-generating vehicles, such that the propulsion-generating vehicles propel the non-propulsion-generating vehicles along the route. The break lines 112 indicate that the vehicle system may be longer and include more vehicles than the five vehicles illustrated in FIG. 1. In an alternative embodiment, the propulsion-generating vehicles are not mechanically coupled to each other (via the non-propulsion-generating vehicles). For example, each of the propulsion-generating vehicles is coupled to a different subset of the non-propulsion-generating vehicles. The propulsion-generating vehicles are communicatively connected to each other to travel with coordinated movements along the route.

In one non-limiting embodiment, the vehicle system is a train, and the route is a railroad track. The propulsion-generating vehicles are locomotives. The non-propulsion-generating vehicles can be rail cars that carry cargo and/or passengers. In another non-limiting embodiment, the vehicle system is a road train, and the route is a road or path. For example, the propulsion-generating vehicles may be trucks (e.g., highway semi-trucks, mining trucks, logging trucks, or the like), and the non-propulsion-generating vehicles may be trailers coupled to the trucks.

The vehicle system may be configured to operate in a distributed power arrangement in which control signals generated from one of the propulsion-generating vehicles are communicated to the other propulsion-generating vehicle to control the movement of the other propulsion-generating vehicle. For example, the first propulsion-generating vehicle 106 may be designated as a lead vehicle that generates control signals for controlling the movement of the second propulsion-generating vehicle 108 that is designated as a remote vehicle. Optionally, the vehicle system may include additional propulsion-generating vehicles that are designated as remote vehicles. The first or lead propulsion-generating vehicle is disposed at the front end of the vehicle system in FIG. 1 but may have another position in the vehicle system in another embodiment. The lead vehicle in the distributed power arrangement optionally need not be located at the front of the vehicle system.

In a distributed power arrangement, the remote propulsion-generating vehicle(s) need to establish a communication link with the lead propulsion-generating vehicle before the remote propulsion-generating vehicle(s) can be controlled by the lead propulsion-generating vehicle. The linking process requires ascertaining the orientation of the remote propulsion-generating vehicle(s) relative to the lead vehicle. Conventionally, the operator may have to physically see the orientation of the lead vehicle with respect to the remote vehicle(s) being linked to determine whether each remote vehicle has the same orientation or an opposite orientation as the lead vehicle. The orientation determination system automatically determines the orientations of the remote vehicles without requiring manual observation of the remote vehicles.

The orientation determination system includes a reference device 114 disposed on the first propulsion-generating vehicle, and two devices 116, 118 disposed on the second propulsion-generating vehicle. The first and second propulsion-generating vehicles are also referred to herein as first and second vehicles. The two devices on the second vehicle includes a front device 116 and a rear device 118 that are spaced apart along a length of the second vehicle. The front device is in front of the rear device. For example, the front device is located more proximate to a front end 120 of the second vehicle than the rear device, and the rear device is located more proximate to a rear end 122 of the second vehicle than the front device.

The orientation determination system determines a first distance 124 that represents a proximity of the first vehicle to the front device on the second vehicle. More specifically, the first distance 124 is defined between the reference device on the first vehicle and the front device on the second vehicle. The orientation determination system also determines a second distance 126 that represents a proximity of the first vehicle to the rear device on the second vehicle. The second distance 126 is defined between the reference device on the first vehicle and the rear device on the second vehicle. The first distance and the second distance are both determined within a short period of time for accuracy, such as within a five second time period or the like.

After determining the first and second distances, the orientation determination system analyzes the distances to determine the orientation of the second vehicle relative to the route. In the illustrated embodiment, the first distance 124 is shorter than the second distance 126, which indicates that the first vehicle is closer (e.g., more proximate) to the front end 120 of the second vehicle than the rear end 122 of the second vehicle. Stated differently, the front end 120 of the second vehicle is located between the first vehicle and the rear end 122 of the second vehicle. As a result, the orientation determination system determines that the second vehicle is facing towards the first vehicle. The orientation of the first vehicle and direction of travel 128 of the vehicle system are known. The first vehicle has a front-facing or forward orientation relative to the direction of travel 128 such that the front end 120 of the first vehicle precedes the rear end 122 of the first vehicle along the route. The first vehicle is disposed in front of the second vehicle in the direction of travel. Based on the first distance being shorter than the second distance, the orientation determination system determines that the second vehicle has the same (e.g., common) orientation as the first vehicle, such that the second vehicle is also front-facing.

If, on the other hand, the second distance is determined to be shorter than the first distance, the orientation determination system determines that the second vehicle is facing away from the first vehicle, and that the second vehicle has an opposite orientation as the first vehicle. For example, if the second vehicle is facing away from the first vehicle, then the rear device will be located between the reference device and the front device, so the second distance is shorter than the first distance. The orientation determination system determines that the second vehicle has a rear-facing or reverse orientation.

In an embodiment, the reference device, the front device, and the rear device are location-determining devices that determine the respective locations of the devices. The locations can be global locations based on global positional coordinates or relative locations that are relative to local reference points. In one or more embodiments, the devices are global positioning system (GPS) devices that generate three-dimensional positional coordinates indicative of the respective locations of the devices. The first distance is determined by calculating the linear distance between the positional coordinates of the reference device and the positional coordinates of the front device. The second distance is determined by calculating the linear distance between the positional coordinates of the reference devices and the positional coordinates of the rear device. Alternatively, instead of global locations, the location-determining devices can determine relative locations of the devices, such as relative to each other and/or relative to off-board equipment (e.g., wayside devices, cellular towers, and/or the like) as the vehicles travel. For example, the front device may monitor a length of time for a message or other signal to be communicated between the front device and the reference device, and utilize the elapsed time based on the speed of signal transmission to determine the relative distance between the two devices.

Figure 2:
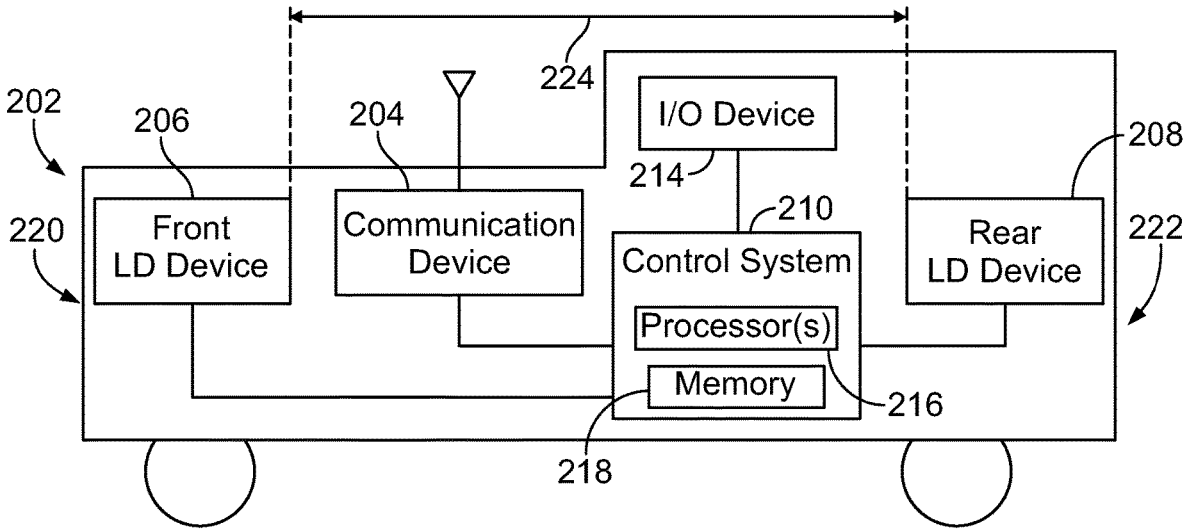
FIG. 2 is a schematic illustration of a propulsion-generating vehicle according to an embodiment.

The route in FIG. 1 is curved along the length. The orientation determination system may be agnostic to the route. For example, the system may operate on any route, such as a linear segment of route or a curved segment of route. In the illustrated embodiment, the route is curved, but the orientation of the second vehicle is determined FIG. 2 is a schematic illustration of a propulsion-generating vehicle 202 according to an embodiment. The propulsion-generating vehicle includes a communication device 204, a front location-determining device 206, a rear location-determining device 208, a control system 210, and a user input/output (I/O) device 214 disposed onboard. The control system 210 is operably connected to the communication device, the front and rear location-determining devices, and the I/O device via wired and/or wireless communication pathways. The I/O device can represent or include a workstation computer, tablet computer, handheld computer, keyboard, touchpad, display device, and/or the like for enabling an operator to interact with the automated systems onboard the vehicle.

The propulsion-generating vehicle 202 may represent the first vehicle 106 and/or the second vehicle 108 shown in FIG. 1. The location-determining devices 206, 208 represent the reference device of the first vehicle and both the front and rear devices of the second vehicle. In an embodiment, the first and second vehicles shown in FIG. 1 may be the same type of vehicle having the same type of components onboard. For example, both the first and second vehicles in FIG. 1 includes a front device and a rear device, illustrated as circles. In FIG. 1, the rear device of the first or lead vehicle operates as the reference device 114 for determining the orientation of the second vehicle, but optionally the front device (unlabeled) can operate as the reference device instead of the rear device. With respect to the second vehicle shown in FIG. 1, the front location-determining device represents the front device and the rear location-determining device represents the rear device. In an alternative embodiment, the reference device onboard the first vehicle may be a different type of device from the front and rear location-determining devices onboard the second vehicle. Furthermore, the first or lead vehicle may not have both a front and a rear device, but rather a single device that operates as the reference device.

The front location-determining device shown in FIG. 2 is located more proximate to a front end 220 of the propulsion-generating vehicle than a proximity of the rear location-determining device to the front end. The rear location-determining device is located more proximate to a rear end 222 of the propulsion-generating vehicle than a proximity of the front location-determining device to the rear end. The front and rear location-determining devices are spaced apart from each other by a separation distance 224 along the length of the vehicle. The separation distance is greater than a margin of error of the location-determining devices. The separation distance may be at least six meters (m). For example, each of the front and rear location-determining devices can determine a respective location of the device within a margin of error less than three meters, such that the combined margin of error is less than six meters. Some non-limiting examples of the separation distance include 10 m, 15 m, or 20 m. Longer separation distances can increase the accuracy of the orientation determination relative to shorter separation distances. In an embodiment, the front and rear location-determining devices are GPS devices that are configured to generate three-dimensional positional coordinates for the respective devices within a global coordinate system. The positional coordinates may define a location along three mutually-perpendicular axes, such as a longitudinal axis, a lateral axis, and an elevational (or vertical) axis. In an alternative embodiment, the front and rear location-determining devices may be proximity devices (e.g., sensors), laser range finders, communication devices (e.g., RF transceivers), and/or the like. In a non-limiting example, the front and rear location-determining devices on the second device are laser range finders that can determine a proximity of the respective device to a designated target on the first vehicle, such as the reference device. In another non-limiting example, the front and rear location-determining devices on the second device include RF transceivers and associated circuitry for wirelessly communication signals with the reference device onboard the first vehicle and determining the respective distances based on time of flight of the signals and/or information within the signals.

The communication device onboard the propulsion-generating vehicle can represent circuitry that can communicate electrical signals wirelessly and/or via wired connections. For example, the communication device can represent transceiving circuitry, one or more antennas, modems, or the like. The transceiving circuitry may include a transceiver or separate transmitter and receiver devices. The electrical signals can form data packets that in the aggregate represent messages. In various embodiments, the control system can generate messages that are communicated remotely by the communication device. The communication device can receive messages and forward the messages to the control system for analysis of the received messages.

The control system performs at least some of the operations described herein to determine the orientation of the vehicles and control movement of the vehicles along the route. The control system represents hardware circuitry that includes and/or is connected with one or more processors 216 (e.g., one or more microprocessors, integrated circuits, microcontrollers, field programmable gate arrays, etc.). The control system includes and/or is connected with a tangible and non-transitory computer-readable storage medium (e.g., memory) 218 disposed onboard the vehicle. For example, the memory may store programmed instructions (e.g., software) that is executed by the one or more processors to perform the operations of the control system described herein. The memory additionally or alternatively may store different information, such as a route database, a trip schedule, parameters of the vehicle (e.g., the separation distance between the front and rear location-determining devices), and/or the like.

The orientation determination system utilizes several of the components of the propulsion-generating vehicle, including for example the front and rear location-determining devices, the communication device, and the control system. Many conventional propulsion-generating vehicles include most of the components utilized in the orientation determination system. The second location-determining device may be the only added component to accomplish the system described herein.

The following description refers to communications between a first vehicle and a second vehicle to determine the orientation of the second vehicle relative to the first vehicle along a route. In a distributed power arrangement, the first vehicle can be a lead vehicle and the second vehicle can be a remote vehicle that is controlled by the first or lead vehicle. The remote vehicle may be communicatively linked with the lead vehicle by an operator on the lead vehicle utilizing the I/O device onboard to enter a user input command to initiate the linking procedure. Alternatively, the operator may use an I/O device off-board the lead vehicle, such as a handheld device, to initiate the linking procedure. The linking procedure may include the communication device onboard the lead vehicle communicating a link request message to the remote vehicle (e.g., and any additional remote vehicles that are part of the distributed power arrangement). The control system onboard the remote vehicle may receive the link request message via the onboard communication device and generate a link response message to be communicated back to the lead vehicle.

In an embodiment, the link response message includes various information, such as an identity of the remote vehicle that is sending the link response message, a location of the front location-determining device onboard the remote vehicle, and a location of the rear location-determining device onboard the remote vehicle. Because the front and rear location-determining devices are spaced apart along the length of the remote vehicle, such as by 10 m, the locations of the front and rear location-determining devices are different. The locations may be represented by positional coordinates in a coordinate system. For example, each location can be represented by a corresponding three-dimensional GPS positional coordinate.

In another embodiment, instead of respective locations of the front and rear location-determining devices, the link response message may include respective distances or proximities of the front and rear location-determining devices relative to the lead vehicle. For example, the front and rear location-determining devices may be range sensors that are configured to target the lead vehicle and determine respective distances between each range sensor and a target component of the lead vehicle. The target component may be a specific device, sign, part, or the like onboard the lead vehicle. Alternatively, the front and rear location-determining devices may communication-based devices that determine the respective proximity distances based on time-of-flight of signals communicated between the location-determining devices and a communication device onboard the lead vehicle. The link response message may include the respective proximity distances generated by the front and rear location-determining devices instead of, or in addition to, the locations of the location-determining devices.

A communication link between the lead and remote vehicles can be established upon receipt of the link response message by the communication device of the lead vehicle. During subsequent travel of the vehicles along the route, the lead vehicle can generate and communicate control signals to the remote vehicle via the communication link. Upon receipt, the remote vehicle implements the control signals such that the movement of the remote vehicle is controlled by the lead vehicle. The control signals may include tractive settings, such as to travel forward at notch setting six for the next 30 seconds. The distributed power arrangement allows the vehicles to travel with coordinated movements from a single control source. Prior to moving along the route, however, the lead vehicle determines the orientation of the remote vehicle. The control signals communicated from the lead vehicle are based on the orientation of the remote vehicle relative to the lead vehicle. For example, if the remote vehicle has an opposite orientation as the lead vehicle, the tractive settings of the control signal may designate the remote vehicle to travel backward at notch setting 6 for the next 30 seconds.

The control system (e.g., one or more processors) of the lead vehicle can analyze and compare the locations of the front and rear location-determining devices. For example, the control system can receive the respective positional coordinates of the front and rear location-determining devices as received by the communication device. The control system can also receive the location (e.g., positional coordinates) of the reference device disposed onboard the lead vehicle, which may represent a GPS device. The control system determines the first distance by calculating a linear distance between the location of the reference device and the location of the front location-determining device on the remote vehicle. The control system determines the second distance by calculating a linear distance between the location of the reference device and the location of the rear location-determining device on the remote vehicle.

After calculating the first and second distances, as shown in FIG. 1, the control system compares the first and second distances. If the first distance is less than the second distance, the control system determines that the remote vehicle is front-facing and has the same orientation as the lead vehicle. If the first distance is greater than the second distance, the control system determines that the remote vehicle is rear-facing and has the opposite orientation as the lead vehicle. After determining the orientation of the remote vehicle, the lead vehicle can generate and communicate control signals to the remote vehicle for controlling the movement of the remote vehicle along the route.

Optionally, the control system may consider the route characteristics when determining the orientation of the remote vehicle. For example, the memory of the control system may store a route database that includes a layout of the route. The layout may be presented in map format. In an embodiment, the control system may access the route database to determine a curvature of the route. For example, upon receiving the respective locations of the front and rear location-determining devices and the reference device, the control system may use the locations and the route database to determine a segment of the route on which the vehicles are located. If the segment of the route may include a curve, a right angle turn (e.g., for road-based vehicles), or the like. If the segment of the route has a curvature greater than a designated threshold, the determinations of the orientation determination system are reversed. For example, the system may determine that the remote vehicle has an opposite orientation as the lead vehicle when the front location-determining device is closer to the lead vehicle than the rear location-determining device.

Figure 3:
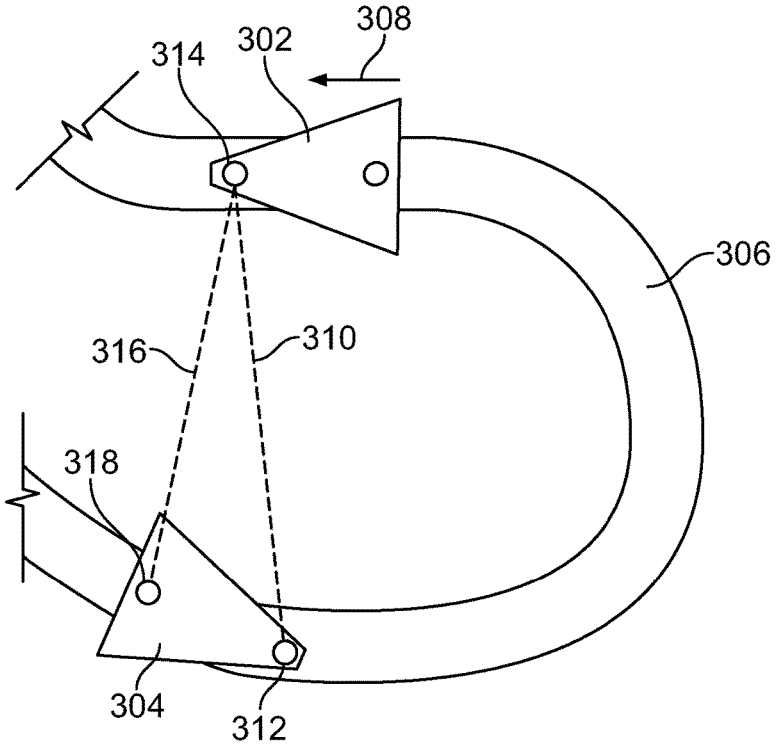
FIG. 3 illustrates a first or lead vehicle and a second or remote vehicle on a curved segment of a route according to an embodiment.

FIG. 3 illustrates a first or lead vehicle 302 and a second or remote vehicle 304 on a curved segment of a route 306. Both the first and second vehicles 302, 304 have the same, front-facing orientation in the direction of travel 308 along the route. The curved segment is greater than the designated threshold. The designated threshold may be 180 degrees or a similar angle, such as 175 degrees, 185 degrees, or the like. The first distance 310 between a front device 312 on the second vehicle and a reference device 314 on the first vehicle is greater than a second distance 316 between a rear device 318 on the second vehicle and the reference device 314. Typically, the rear device 318 being closer to the first vehicle than the front device 312 indicates that the second vehicle has an opposite orientation as the first vehicle. However, because the route curvature is greater than the threshold, the rear device 318 being closer to the first vehicle than the front device 312 indicates that the two vehicles have the same orientation.

Referring now back to FIG. 2, the control system of the orientation determination system can provide information in addition to the orientation of the second or remote vehicle. For example, utilizing the three-dimensional positional coordinates, the control system can determine an elevation of the second vehicle relative to the first vehicle. The elevational information can be utilized by the control system when generating the control signals for controlling the second vehicle. For example, if the second vehicle is located at a greater elevation than the first vehicle which is located in front of the second vehicle along the direction of travel, then the control system determines that the second vehicle is or will be descending in elevation. The control signals may be generated based at least in part on the upcoming change in elevation of the second vehicle.

In another example, the control system is configured to determine the skew or angle of the second vehicle relative to the first vehicle. The skew is more specific than the orientation as front-facing or rear-facing. The skew can be determined by calculating a difference between the first distance 124 and the second distance 126 shown in FIG. 1. For example, the second distance may be greater than the first distance by five meters. The difference between the first and second distances is then compared to the known separation distance between the front and rear location-determining devices (e.g., the separation distance 224 shown in FIG. 2) to determine the skew. If the difference between the first and second distances is approximately equal to the separation distance, then the second vehicle has little or no skew relative to the first vehicle. For example, the second vehicle points towards the first vehicle. In, on the other hand, the separation distance is significantly greater than the measured difference between the first and second distances, then the second vehicle is skewed relative to the first vehicle. For example, the second vehicle does not point directly towards the first vehicle. The control system may also compare the skew of the second vehicle to the segment of the route according to the route database.

The orientation determination system described herein can also be utilized to determine the orientation of additional "second" vehicles to the first vehicle (e.g., a third vehicle, a fourth vehicle, and the like) by the same procedure. In an embodiment, after determining the orientation of the second vehicle relative to the first vehicle and the orientation of a third vehicle relative to the first vehicle, the control system can transitively deduce the orientation of the second and third vehicles relative to each other.

Optionally, the orientation determination system may also monitor changes in the relative distances between the vehicles over time during movement. For example, the control system may utilize the first and second distances, measured during movement, to determine whether a separation gap between the first and second vehicles is increasing or decreasing.

Figure 4:
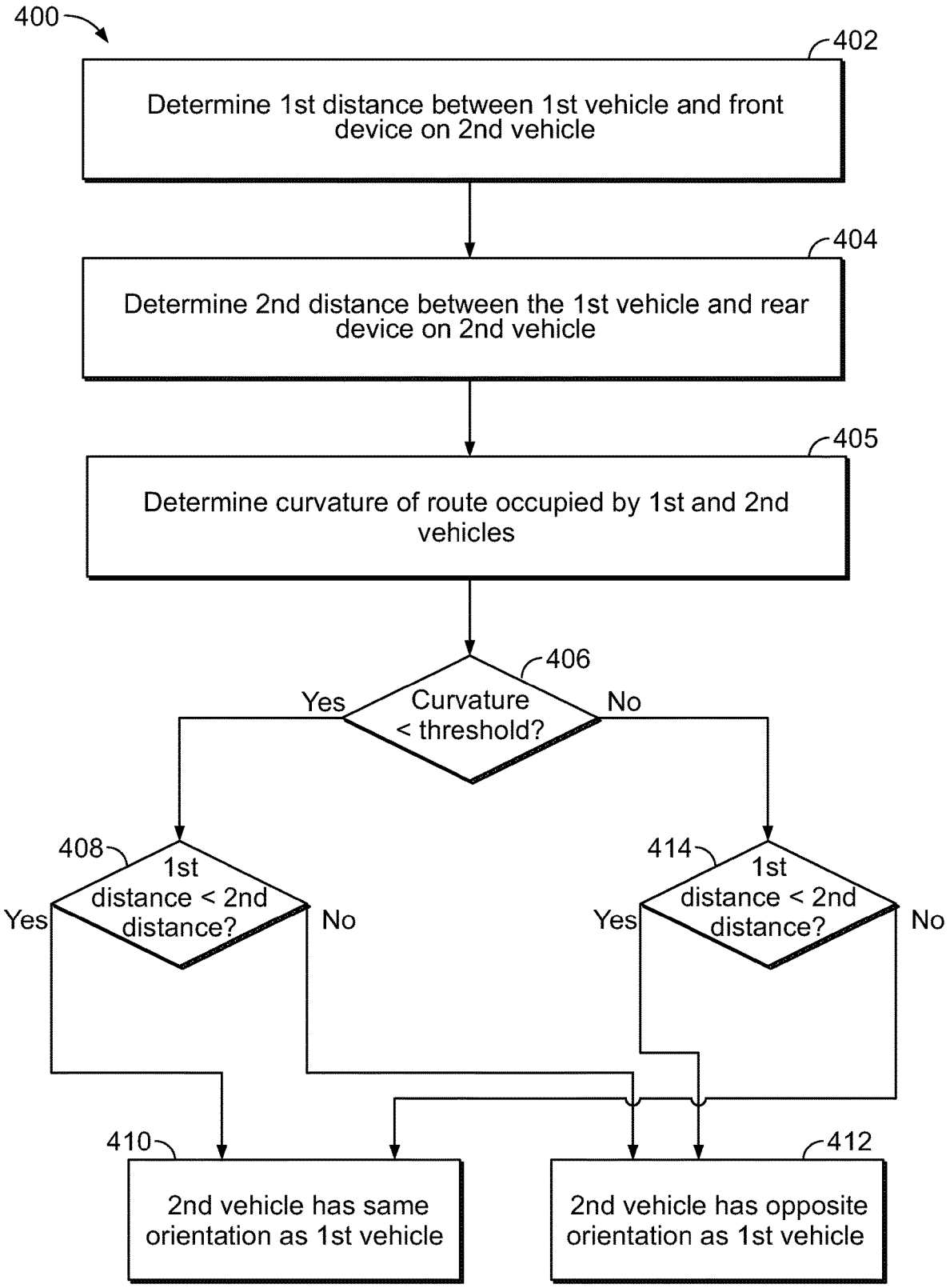
FIG. 4 is a flow chart of a method for determining a vehicle orientation according to an embodiment.

FIG. 4 is a flow chart 400 of a method for determining a vehicle orientation according to an embodiment. The method may be performed by the orientation determination system described above with reference to FIGS. 1-3. The method optionally includes additional steps than shown, fewer steps than shown, and/or different steps than shown. At 402, a first distance is determined between a first vehicle and a front device disposed on a second vehicle. The first and second vehicles are both disposed on a route. Determining the first distance may include receiving, at one or more processors, respective locations of a reference device onboard the first vehicle and the front device onboard the second vehicle, and then calculating a linear distance between the location of the reference device and the location of the front device. For example, the reference device and the front device may be GPS receivers. Alternatively, the first distance may be determined by the front device calculating a proximity of the first vehicle to the front device. For example, the front device may be a distance sensor, such as a laser range sensor. In another embodiment, the first distance may be determined based on time-of-flight of signals communicated between the first vehicle and the second vehicle.

At 404, a second distance is determined between the reference device disposed on the first vehicle and a rear device disposed on the second vehicle. The front device is spaced apart from the rear device along a length of the second vehicle. The front device is located more proximate to a front end of the second vehicle than a proximity of the rear device to the front end. The second distance may be determined using a similar process as the determination of the first distance. For example, determining the second distance may include receiving, at one or more processors, a location of the rear device, and then calculating a linear distance between the location of the rear device and the previously-received location of the reference device.

At 405, a curvature of the route along the segment occupied by the vehicles is determined. The curvature of the route may be determined by accessing a route database stored in a memory of a control system. The segment that is occupied by the vehicles can be determined based on the received locations of the devices onboard the vehicles.

At 406, it is determined whether the curvature of the route is less than a designated threshold. The threshold may be 180 degrees. If the curvature of the route is less than the threshold, the method proceeds to 408, and it is determined whether the first distance is less than the second distance. If the first distance is less than the second distance, meaning that the front device of the second vehicle is located closer than the rear device to the first vehicle, then the method proceeds to 410 and it is determined that the second vehicle has the same (e.g., a common) orientation as the first vehicle relative to the route and the direction of travel. If the first distance is greater than the second distance, meaning that the rear device of the second vehicle is located closer than the front device to the first vehicle, then the method proceeds to 412 and it is determined that the second vehicle has an opposite orientation as the first vehicle relative to the route and the direction of travel.

Referring back to 406, if the curvature of the route is instead greater than the threshold, the method proceeds to 414, and it is determined whether the first distance is less than the second distance. If the first distance is less than the second distance, meaning that the front device of the second vehicle is located closer than the rear device to the first vehicle, then the method proceeds to 412 and it is determined that the second vehicle has an opposite orientation as the first vehicle relative to the route and the direction of travel. If the first distance is greater than the second distance, meaning that the rear device of the second vehicle is located closer than the front device to the first vehicle, then the method proceeds to 410 and it is determined that the second vehicle has the same orientation as the first vehicle relative to the route and the direction of travel (as shown in FIG. 3).

Optionally, the method may also include determining a difference between the first distance and the second distance, and then comparing the difference to the separation distance to determine a skew of the second vehicle relative to the first vehicle.

In one or more embodiments, a method for determining a vehicle orientation is provided that includes determining a first distance between a reference device disposed on a first vehicle and a front device disposed on a second vehicle. The first and second vehicles both disposed on a route. The method includes determining a second distance between the reference device disposed on the first vehicle and a rear device disposed on the second vehicle. The front device is located more proximate to a front end of the second vehicle than a proximity of the rear device to the front end. The method includes determining that the second vehicle has a common orientation as the first vehicle relative to the route based on the first distance being less than the second distance.

Optionally, the method further includes determining that the second vehicle has an opposite orientation as the first vehicle relative to the route based on the first distance being greater than the second distance. Optionally, the first vehicle is disposed in front of the second vehicle in a direction of travel of the first vehicle along a route. Optionally, the reference device, the front device, and the rear device are global positioning system (GPS) devices. The GPS devices may generate three-dimensional positional coordinates. The method may include using the positional coordinates to determine an elevation of the second vehicle relative to the first vehicle. Optionally, the first and second vehicles are rail vehicles.

Optionally, determining the first distance includes receiving, at one or more processors, respective locations of the reference device and the front device and calculating a linear distance between the location of the reference device and the location of the front device. Determining the second distance may include receiving, at one or more processors, a location of the rear device and calculating a linear distance between the location of the reference device and the location of the rear device.

Optionally, the front device is spaced apart from the rear device by a separation distance along a length of the second vehicle. The front device may be spaced apart from the rear device by at least 6 meters along the length of the second vehicle. The method further includes determining a difference between the first distance and the second distance and comparing the difference to the separation distance to determine a skew of the second vehicle relative to the first vehicle.

Optionally, the method also includes determining a curvature of the route on which the first and second vehicles are disposed. Determining that the second vehicle has the common orientation as the first vehicle may also be based on the curvature of the route. Optionally, the method also includes communicating control signals from the first vehicle to the second vehicle to control movement of the second vehicle along the route.

In one or more embodiments, a system is provided that includes one or more processors configured to determine a first distance between a reference device disposed on a first vehicle and a front device disposed on a second vehicle. The first and second vehicles are both disposed on a route. The one or more processors are further configured to determine a second distance between the reference device disposed on the first vehicle and a rear device disposed on the second vehicle. The front device is located more proximate to a front end of the second vehicle than a proximity of the rear device to the front end. The one or more processors are configured to determine that the second vehicle has a common orientation as the first vehicle relative to the route based on the first distance being less than the second distance.

Optionally, the one or more processors are configured to determine that the second vehicle has an opposite orientation as the first vehicle relative to the route based on the first distance being greater than the second distance. Optionally, the one or more processors are configured to generate control signals, based on the orientation of the second vehicle, for communication to the second vehicle to control movement of the second vehicle along the route. Optionally, the one or more processors are disposed onboard the first vehicle, and the system further includes a communication device disposed onboard the first vehicle and operably connected to the one or more processors. The communication device may be configured to receive a message that includes respective positional coordinates of the front device and the rear device of the second vehicle. Optionally, the one or more processors are configured to determine the first distance and the second distance in response to receiving a user input command via an input device onboard the first vehicle or the second vehicle.

Optionally, the reference device, the front device, and the rear device are global positioning system (GPS) devices. Optionally, the one or more processors determine the first distance by receiving respective locations of the reference device and the front device and calculating a linear distance between the location of the reference device and the location of the front device. The one or more processors may determine the second distance by receiving a location of the rear device and calculating a linear distance between the location of the reference device and the location of the rear device. Optionally, the front device is spaced apart from the rear device by a separation distance along a length of the second vehicle. The one or more processors are configured to determine a difference between the first distance and the second distance and compare the difference to the separation distance to determine a skew of the second vehicle relative to the first vehicle.

In one or more embodiments, a system is provided that includes one or more processors disposed onboard a first vehicle of a vehicle system. The one or more processors are configured to receive, via a communication device onboard the first vehicle, a location of a front device disposed onboard a second vehicle of the vehicle system and a location of a rear device disposed onboard the second vehicle. The front device is located more proximate to a front end of the second vehicle than a proximity of the rear device to the front end. The one or more processors are configured to determine an orientation of the second vehicle relative to the first vehicle along a route based on a comparison of respective proximities of the front device and the rear device to a location of the first vehicle.

In one or more embodiments, a method is provided that includes receiving, via a communication device disposed onboard a first vehicle, a location of a front device onboard a second vehicle disposed on a route. The method also includes receiving, via the communication device, a location of a rear device onboard the second vehicle. The front device is located more proximate to a front end of the second vehicle than a proximity of the rear device to the front end. The method includes determining an orientation of the second vehicle relative to the first vehicle along the route based on a comparison of respective proximities of the locations of the front and rear devices to the first vehicle.

As used herein, the terms "processor" and "computer," and related terms, e.g., "processing device," "computing device," and "controller" may be not limited to just those integrated circuits referred to in the art as a computer, but refer to a microcontroller, a microcomputer, a programmable logic controller (PLC), field programmable gate array, and application specific integrated circuit, and other programmable circuits. Suitable memory may include, for example, a computer-readable medium. A computer-readable medium may be, for example, a random-access memory (RAM), a computer-readable non-volatile medium, such as a flash memory. The term "non-transitory computer-readable media" represents a tangible computer-based device implemented for short-term and long-term storage of information, such as, computer-readable instructions, data structures, program modules and sub-modules, or other data in any device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. As such, the term includes tangible, computer-readable media, including, without limitation, non-transitory computer storage devices, including without limitation, volatile and non-volatile media, and removable and non-removable media such as firmware, physical and virtual storage, CD-ROMS, DVDs, and other digital sources, such as a network or the Internet.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A system comprising:

one or more processors configured to determine a first distance between a reference device disposed on a first vehicle and a front device disposed on a second vehicle, the first and second vehicles both disposed on a route, the one or more processors further configured to determine a second distance between the reference device disposed on the first vehicle and a rear device disposed on the second vehicle, wherein the front device is located more proximate to a front end of the second vehicle than a proximity of the rear device to the front end, the one or more processors configured to determine an orientation of the second vehicle along the route relative to the first vehicle based on a comparison between the first distance and the second distance, and the one or more processors configured to generate control signals, based on the orientation of the second vehicle, for communication to the second vehicle to control movement of the second vehicle along the route.

2. The system of claim 1, wherein the first vehicle is disposed in front of the second vehicle along the route relative to a direction of travel, and the one or more processors are configured to determine that the orientation of the second vehicle along the route is a rear-facing orientation relative to the direction of travel based on the first distance being greater than the second distance.

3. The system of claim 1, wherein the one or more processors are disposed onboard the first vehicle, and the system further includes a communication device disposed onboard the first vehicle and operably connected to the one or more processors, the communication device configured to receive a message that includes respective positional coordinates of the front device and the rear device of the second vehicle.

4. The system of claim 1, wherein the one or more processors are configured to determine the first distance and the second distance in response to receiving a user input command via an input device onboard the first vehicle or the second vehicle.

5. The system of claim 1, wherein the reference device, the front device, and the rear device are global positioning system (GPS) devices.

6. The system of claim 1, wherein the one or more processors determine the first distance by receiving respective locations of the reference device and the front device and calculating a linear distance between the location of the reference device and the location of the front device, and the one or more processors determine the second distance by receiving a location of the rear device and calculating a linear distance between the location of the reference device and the location of the rear device.

7. The system of claim 1, wherein the front device is spaced apart from the rear device by a separation distance along a length of the second vehicle, the one or more processors configured to compare a difference between the first distance and the second distance to the separation distance to determine a skew of the second vehicle relative to the first vehicle.

8. The system of claim 1, wherein the first vehicle is disposed in front of the second vehicle along the route relative to a direction of travel, and the one or more processors are configured to determine that the orientation of the second vehicle along the route is a front-facing orientation relative to the direction of travel based on the first distance being less than the second distance.

9. A method for determining a vehicle orientation, the method comprising:

determining, via one or more processors, a first distance between a reference device disposed on a first vehicle and a front device disposed on a second vehicle, the first and second vehicles both disposed on a route;

determining a second distance between the reference device disposed on the first vehicle and a rear device disposed on the second vehicle, wherein the front device is located more proximate to a front end of the second vehicle than a proximity of the rear device to the front end;

determining an orientation of the second vehicle along the route relative to the first vehicle based on a comparison between the first distance and the second distance; and communicating control signals from the first vehicle to the second vehicle to control movement of the second vehicle along the route, the control signals generated by the one or more processors based on the orientation of the second vehicle.

10. The method of claim 9, wherein the first vehicle is disposed in front of the second vehicle along the route relative to a direction of travel, and determining the orientation of the second vehicle comprises determining that the orientation of the second vehicle is a rear-facing orientation relative to the direction of travel based on the first distance being greater than the second distance.

11. The method of claim 9, wherein the first vehicle is disposed in front of the second vehicle in a direction of travel of the first vehicle along the route.

12. The method of claim 9, wherein the reference device, the front device, and the rear device are global positioning system (GPS) devices.

13. The method of claim 12, wherein the GPS devices generate three-dimensional positional coordinates and the method includes using the positional coordinates to determine a difference in elevation between the first vehicle and the second vehicle.

14. The method of claim 9, wherein determining the first distance includes receiving, at the one or more processors, respective locations of the reference device and the front device and calculating a linear distance between the location of the reference device and the location of the front device, and determining the second distance includes receiving, at the one or more processors, a location of the rear device and calculating a linear distance between the location of the reference device and the location of the rear device.

15. The method of claim 9, wherein the front device is spaced apart from the rear device by a separation distance along a length of the second vehicle, the method further comprising:

comparing a difference between the first distance and the second distance to the separation distance to determine a skew of the second vehicle relative to the first vehicle.

16. The method of claim 9, wherein the front device is spaced apart from the rear device by at least six meters along a length of the second vehicle.

17. The method of claim 9, further comprising determining a curvature of the route on which the first and second vehicles are disposed, wherein the orientation of the second vehicle along the route is determined based on the curvature of the route as well as the comparison between the first distance and the second distance.

18. The method of claim 9, wherein the first and second vehicles are rail vehicles.

19. The method of claim 9, wherein the first vehicle is disposed in front of the second vehicle along the route relative to a direction of travel, and determining the orientation of the second vehicle comprises determining that the orientation of the second vehicle is a front-facing orientation relative to the direction of travel based on the first distance being less than the second distance.

20. A system comprising:

one or more processors disposed onboard a first vehicle of a vehicle system, the one or more processors configured to receive, via a communication device onboard the first vehicle, a first location of a front device disposed onboard a second vehicle of the vehicle system and a second location of a rear device disposed onboard the second vehicle, wherein the front device is located more proximate to a front end of the second vehicle than a proximity of the rear device to the front end, the one or more processors configured to determine an orientation of the second vehicle along a route relative to the first vehicle based on a comparison between a first distance and a second distance, the first distance extending from the first location of the front device to a reference location of a reference device disposed onboard the first vehicle, the second distance extending from the second location of the rear device to the reference location of the reference device, the one or more processors configured to generate control signals, based on the orientation of the second vehicle, for communication to the second vehicle to control movement of the second vehicle along the route.

* * * * *